US005106492A

United States Patent [19]

Distinti et al.

[11] Patent Number: 5,106,492

[45] Date of Patent: Apr. 21, 1992

[54] SOLAR POWERED SWIMMING POOL SKIMMER

[76] Inventors: John A. Distinti, 96 Lawrence Hill Rd.; Robert G. Fonti, 15 Horizon Dr., both of Huntington, N.Y. 11743

[21] Appl. No.: 622,958

[22] Filed: Dec. 6, 1990

[51] Int. Cl.[5] ..... E04H 4/16

[52] U.S. Cl. ..... 210/91; 210/104; 210/113; 210/169; 210/242.1; 15/1.7; 4/490; 73/862.67

[58] Field of Search ..... 210/85, 86, 91, 104, 210/111, 113, 169, 242.1, 242.3; 15/1.7; 4/490; 73/862.67

[56] References Cited

U.S. PATENT DOCUMENTS

| | | | |
|---|---|---|---|
| 3,268,081 | 8/1966 | Menkee et al. | 210/242.1 |
| 3,656,624 | 4/1972 | Walton | 210/242.3 |
| 3,731,813 | 5/1973 | Tipton | 210/242.3 |
| 3,785,496 | 1/1974 | Smith, Jr. | 210/242.3 |
| 3,928,206 | 12/1975 | Waren | 210/242.3 |
| 3,956,927 | 5/1976 | Pearson | 73/855 |
| 4,042,049 | 8/1977 | Reichow et al. | 73/767 |
| 4,085,049 | 4/1978 | Hartwick et al. | 210/242.3 |
| 4,737,275 | 4/1988 | Franks | 210/91 |
| 4,789,470 | 12/1988 | Wards | 210/169 |
| 4,802,592 | 2/1989 | Wessels | 210/169 |
| 4,820,411 | 4/1989 | Lempio | 210/169 |
| 4,900,432 | 2/1990 | Arnold et al. | 210/242.1 |
| 4,976,850 | 12/1990 | Kurlitz | 210/104 |

*Primary Examiner*—Stanley S. Silverman
*Assistant Examiner*—Christopher Upton
*Attorney, Agent, or Firm*—Terry M. Gernstein

[57] ABSTRACT

A swimming pool skimmer includes a paddle wheel that directs fluid and debris into a debris catcher. The paddle wheel is turned by a motor that is powered from an array of solar cells. A solar concentrator focuses solar energy onto the solar cells, and an alarm circuit includes a strain gauge on the debris catcher. The strain gauge forms one leg of a bridge circuit that is connected to a comparator having a feedback loop. The output of the comparator is connected to an alarm element either directly or remotely.

12 Claims, 4 Drawing Sheets

FIG. 2
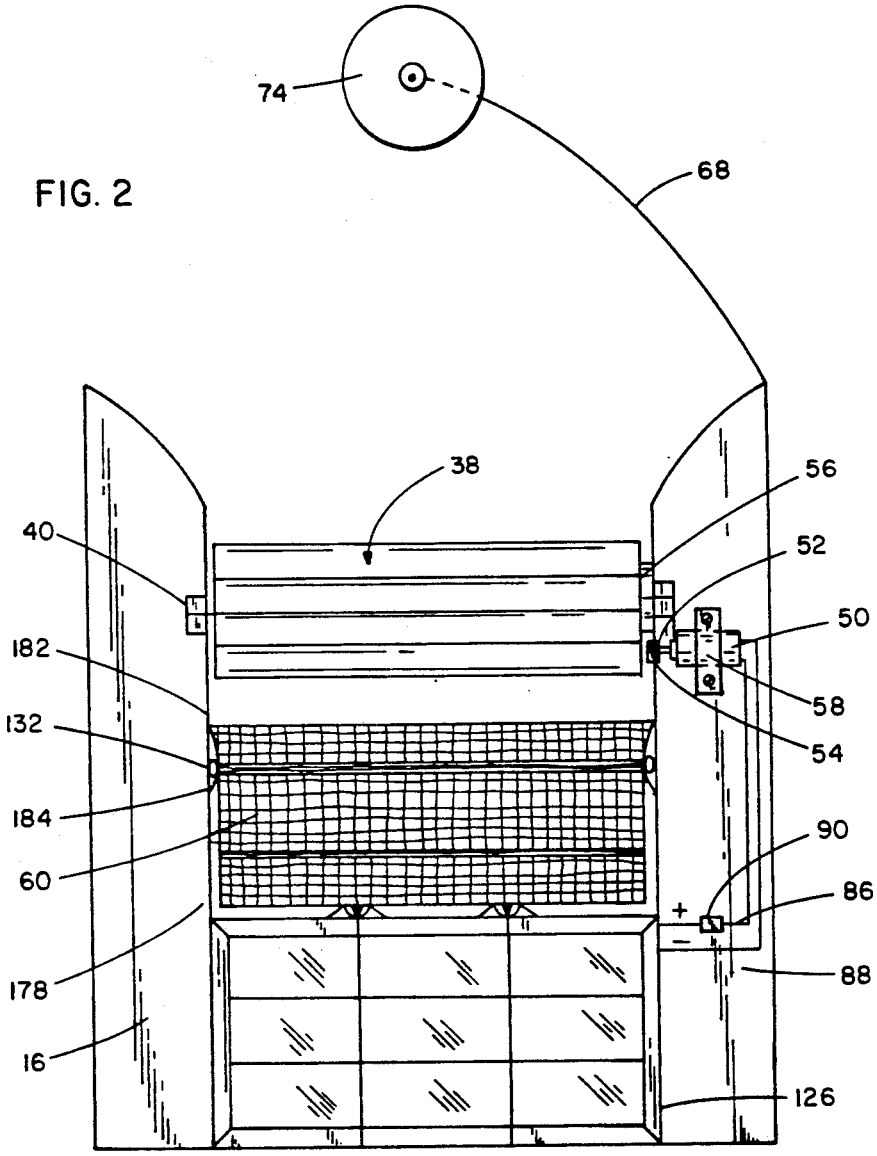
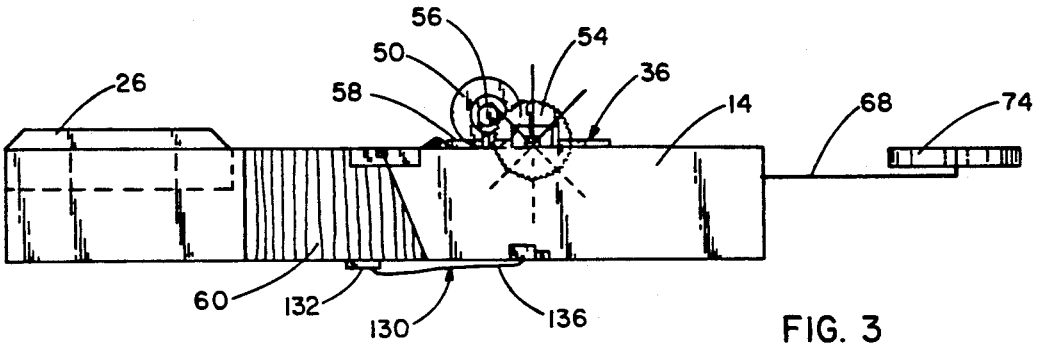
FIG. 3

SOLAR POWERED SWIMMING POOL SKIMMER

TECHNICAL FIELD OF THE INVENTION

The present invention relates to the general art of water treatment, and to the particular field of swimming pool skimmers.

BACKGROUND OF THE INVENTION

As most owners of outdoor swimming pools know, keeping the pool free of debris, such as leaves and the like, can be an onerous job. If such floating debris is not removed from the pool, it often sinks and must be vacuumed from the pool before it has a chance to clog the filter system of the pool. Vacuuming a swimming pool is a difficult and burdensome task which most pool owners would rather be kept to a minimum.

For this reason, the art has included several proposals for skimmer devices which float on top of the water in a swimming pool and remove floating debris. While somewhat successful, these skimmer devices have several drawbacks. For example, some of these devices must be plugged into a source of electrical power. Not only can this be dangerous, it may also limit the area of the pool which can be covered by the skimmer. An electrical cord can also have a tendency to tangle thereby further limiting the area covered by the skimmer.

A further drawback with many known swimming pool skimmer devices is that the efficiency thereof may decrease as more and more debris is collected. In fact, if the skimmer device becomes too full, it may actually jam thereby not only reducing its effectiveness, but also possibly endangering the parts thereof.

Therefore, there is a need for a swimming pool skimmer assembly which does not require a cord to operate and which has a reduced possibility of becoming jammed.

OBJECTS OF THE INVENTION

It is a main object of the present invention is to provide a swimming pool skimmer assembly which does not require a cord to operate.

It is another object of the present invention to provide a swimming pool skimmer assembly which does not require a cord to operate and which has a reduced possibility of becoming jammed.

SUMMARY OF THE INVENTION

These, and other, objects are achieved by a swimming pool skimmer assembly which is powered by an efficient solar power system and which has an alarm system which signals when a debris catcher portion of the skimmer is in danger of becoming overfilled. The solar power system includes a concentrator element which increases the efficiency of the power system so a small and compact pool skimmer can provide skimming which is sufficient for even large swimming pool areas.

The system includes a stain gauge connected to a comparator element. An alarm element is connected to the output of the comparator and is activated when a voltage appears at the output of the comparator. The alarm can be audible or visual and can be mounted on the skimmer or operated via a remote control mounted on the skimmer. In the latter case, the alarm can be placed in any convenient location.

The skimmer assembly of the present invention therefore is small, yet efficient and is unencumbered by cords or elements which can interfere with the skimmer's movement about a swimming pool. The skimmer is not in danger of becoming jammed due to overfilling, and thus will remain reliable and efficient during it operation.

BRIEF DESCRIPTION OF THE DRAWING FIGURES

FIG. 2 is a top plan view thereof.

FIG. 3 is a side elevational view thereof.

DETAILED DESCRIPTION OF THE PREFERRED EMBODIMENT OF THE INVENTION

Figure 1:
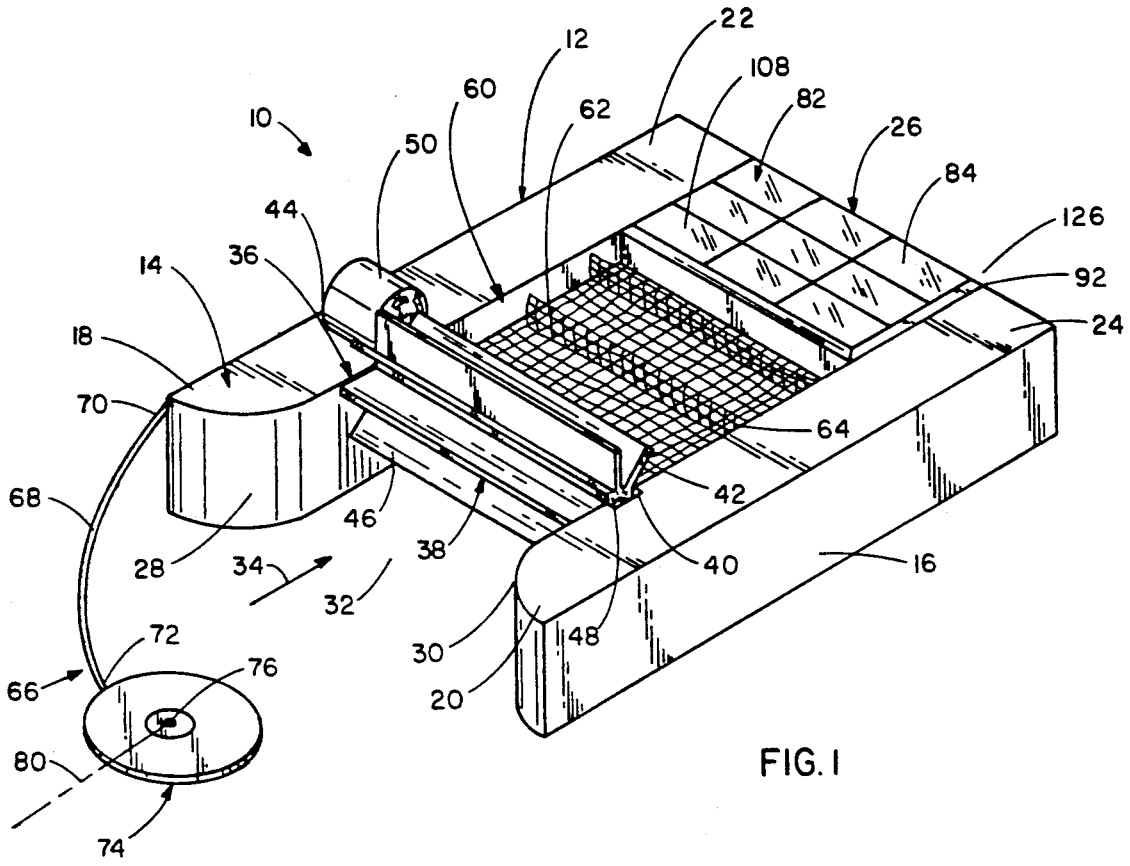
FIG. 1 is a perspective view of a swimming pool skimmer assembly embodying the present invention.
Figure 4:
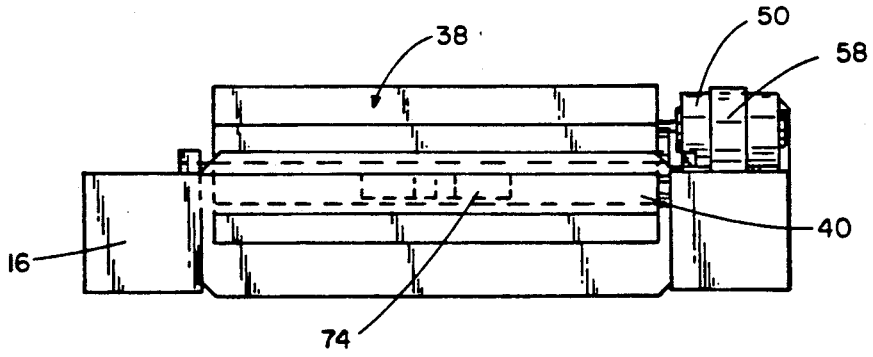
FIG. 4 is an end elevational view thereof.

Shown in FIGS. 1–4 is a swimming pool skimmer assembly 10 which includes a floatable U-shaped housing 12. The housing is formed by two parallel and spaced apart legs 14 and 16 each of which has a fore end 18 and 20 respectively and an aft end 22 and 24 respectively. The aft ends are connected together by a connecting leg 26. The parallel legs form pontoons for the assembly and have inwardly curved surfaces 28 and 30 on the fore ends 18 and 20 respectively. These inwardly curved surfaces cooperate to define an entranceway 32 through which fluid, such as swimming pool water having floating debris therein, flows in the direction indicated by arrow 34. Accordingly, directions, such as "upstream" and "downstream" will be taken with reference to the direction arrow 34, with the arrow showing the flow direction.

A paddle wheel assembly 36 is mounted on the housing, and includes a paddle wheel 38 having a central axle 40 extending longitudinally therethrough from port end 42 to starboard end 4 thereof. A plurality of paddle blades, such as blade 46, are mounted on a hub 48 through which the axle extends and to which the axle is fixedly attached. The axle is rotatably mounted on the housing so the entire paddle wheel can rotate when the axle is rotated. Rotation of the paddle wheel moves fluid and debris in the downstream direction 34.

A motor 50 is mounted on the housing adjacent to the paddle wheel axle, and has an output shaft 52 attached to the paddle wheel axle by a gear 54 attached to a reducer system 56. A clamp 58 is used to affix the motor to the housing.

A debris catcher 60 is mounted on the housing near the connecting leg 26 and includes a foraminous screen 62 that has an entrance section 64 located adjacent to and downstream of the paddle wheel assembly to receive fluid and debris therefrom.

Fluid flows through the screen, however, debris will be retained on the screen.

The skimmer assembly further includes a deflection assembly 66 which prevents the skimmer from becoming jammed against a wall of the swimming pool. The deflection assembly includes an arm 68 having a proximal end 70 attached to the housing and a proximal end 72 to which is connected a circular bumper wheel 74 having a center 76. The bumper wheel will collide with a wall or a corner of the swimming pool and, due to the curved shape of the arm 68, will guide the skimmer away from the wall. The circular shape of the wheel and its freedom to turn co-operates with the curved arm to guide the skimmer away from a wall. The curvature of the arm and its length are arranged to locate the bumper wheel center 76 along longitudinal centerline 80 of the housing so that any collision between the bumper wheel and a wall will guide the skimmer away from the wall. The bumper wheel is located near the top of the housing, as is best shown in FIG. 3, and is made of floatable material, such as plastic or the like. The arm 68 is preferably metal which has some flexible features.

The motor 50 is a d.c. electric motor which is powered from a power source held onboard the housing so that there are no cords or the like which might interfere with the operation and movement of the skimmer. The onboard power source includes an array 82 of solar cells, such as solar cell 84. The array of solar cells is electrically connected to the motor via line conductors 86 and 88, with the line conductor 86 having an on/off switch 90 therein. A protective magnifier cover 92 is also mounted on the housing.

Figure 5B:
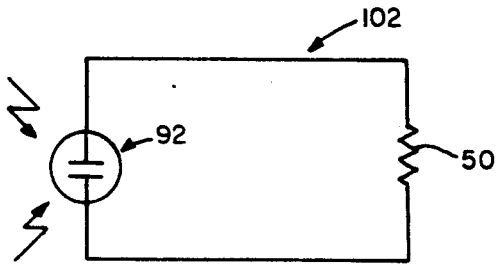
FIG. 5B illustrates the solar power circuit of the skimmer assembly.
Figure 5A:
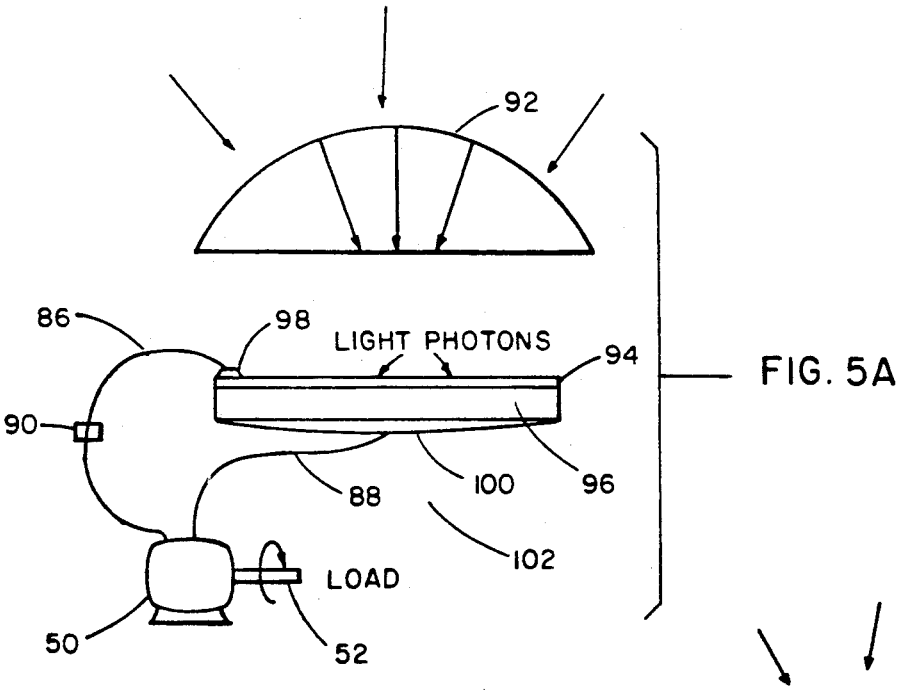
FIG. 5A illustrates the solar power circuit of the skimmer assembly.

As best shown in FIGS. 5A and 5B, each solar cell 84 includes a diffused p-type layer 94 upon which light photons are incident, an original n-type silicon wafer 96 and soldered contacts 98 and 100 electrically connected to line conductors 86 and 88 respectively. When light strikes the top surface of the cell, a positive electric current flows from the top contact through the load to the bottom contact. A circuit 102 connecting the solar cell array to the load is shown in FIG. 5A.

Figure 6:
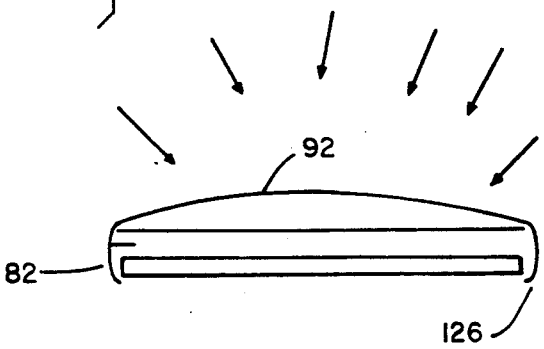
FIG. 6 is a perspective view of a solar concentrator used in the skimmer assembly.

The skimmer also includes a magnifying lens 92 shown in FIGS. 1, 5A and 6. The magnifying lens 92 is attached to the sides of the skimmer housing by means of flexible seals 126 and which directs sunlight onto the array of solar cells as indicated in FIG. 6.

Figure 7:
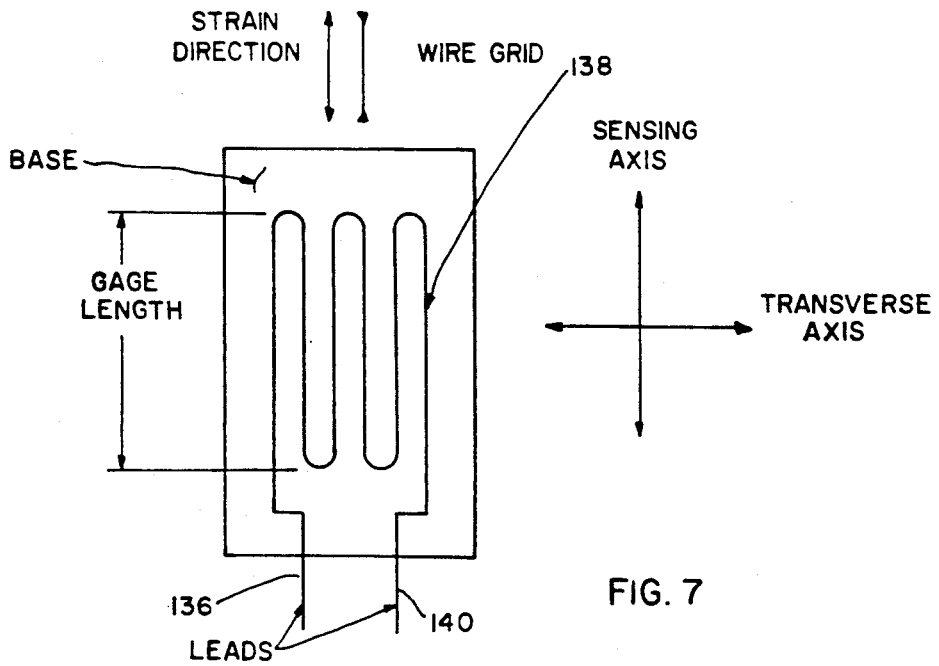
FIG. 7 illustrates a strain gauge used in an alarm circuit of the skimmer assembly to signal if a debris catcher of the assembly is in danger of becoming overfilled.
Figure 8:
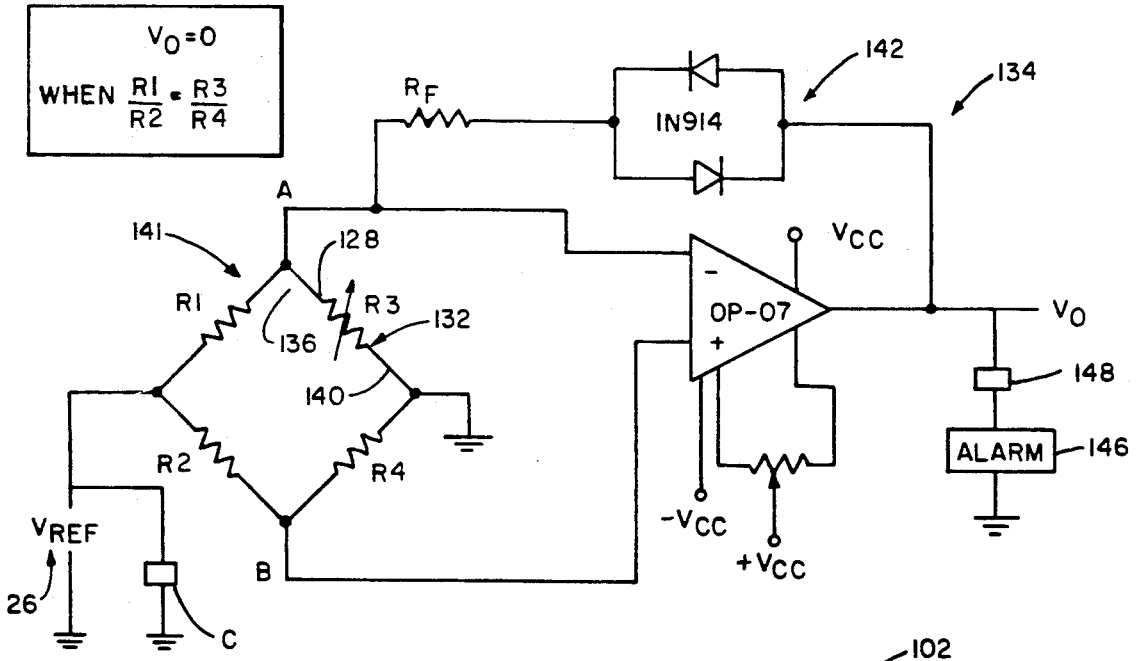
FIG. 8 is a circuit diagram of the alarm circuit.

As best shown in FIGS. 3, 7 and 8, the skimmer assembly further includes an alarm system 130 connected to the debris catcher and signalling, either audibly or visually, when the debris catcher contains more than a predetermined amount of material. Such predetermined amount of material is set according to what amount of material is likely to jam the paddle wheel, or to cause the skimmer to lose buoyancy.

The alarm system includes a strain gauge 132 mounted on the debris catcher, and electrically connected to an alarm circuit 134 by line conductors, such as lead 136. The strain gauge is shown in FIG. 7 as including a wire grid 138 connected to leads 136 and 140. The strain gauge senses strain of the debris catcher and alters its resistance accordingly.

As shown in FIG. 8, the strain gauge is used as resistor $R_3$ in a Bridge circuit 141. The 1N914 diodes in a feedback loop 142 result in a high sensitivity for the circuit. The bridge is set to be balanced for debris weights below the predetermined level, and when the bridge is unbalanced, the amplifier OP-07 acts as a comparator element and produces a voltage $V_O$. This voltage is applied to the alarm element 146 either directly or via a remote control system 148 to activate such alarm element. The alarm element can be audible or visual as suitable.

As is shown in FIG. 8, the solar array can be used as the power source for the bridge circuit.

Figure 9:
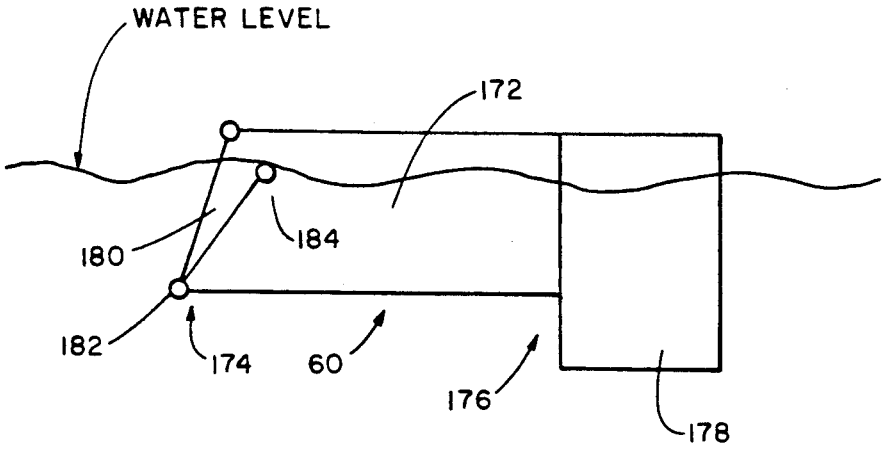
FIG. 9 is a side elevational view of an alternative form of a skimmer debris collection basket.

Shown in FIG. 9 is a debris catcher 60 which can be used in place of the debris catcher 60. The debris catcher 60 includes a basket 172 having a first end 174 and a second end 176 to which a chlorinator 178 is affixed. A door 180 is attached to the first end of the basket by a pivot connection 182 and includes a buoyant material element 184. The door is weighted and pivoted so it will open to permit debris to enter the basket when the device is in motion, but will close when the device is at rest.

It is understood that while certain forms of the present invention have been illustrated and described herein, it is not to be limited to the specific forms or arrangements of parts described and shown.

We claim:

1. A swimming pool skimmer assembly comprising:

(A) a U-shaped housing which includes two spaced-apart pontoons and a leg connecting said pontoons together, each of said pontoons including an aft end connected to said leg and a fore end, said fore ends being curved and together defining an entranceway;

(B) a paddle wheel assembly mounted on said housing and including (1) a motor having an output shaft, (2) a gear reduction assembly connected to said motor output shaft, and (3) a paddle wheel means connected to said gear reduction assembly and spanning from one pontoon to the other pontoon for being contacted by fluid moving through said entranceway, said paddle wheel means having a support axle means connected to said housing for mounting said paddle wheel means for rotation so that said paddle wheel rotates to force fluid through said entranceway;

(C) a debris catcher mounted on said housing adjacent to said paddle wheel to receive fluid from said paddle wheel and to retain debris;

(D) power means on said housing and connected to said motor, said power means including (1) a solar cell array mounted on said housing connecting leg, and electrically connected to said motor, and (2) a solar concentrator mounted on said housing adjacent to said solar cell; and (E) an alarm circuit means connected to said debris catcher for signalling when said debris catcher has more than a predetermined amount of debris therein, and including a strain gauge mounted on said debris catcher.

2. The swimming pool skimmer assembly defined in claim 1 wherein said alarm circuit further includes a bridge circuit in which said strain gauge is connected as one leg thereof.

3. The swimming pool skimmer assembly defined in claim 2 wherein said alarm circuit further includes a comparator element.

4. The swimming pool skimmer assembly defined in claim 3 wherein said alarm circuit further includes an alarm element connected to said comparator element.

5. The swimming pool skimmer assembly defined in claim 4 wherein said alarm circuit further includes a feedback loop around said comparator element.

6. The swimming pool skimmer assembly defined in claim 5 wherein said feedback loop includes a diode.

7. The swimming pool skimmer assembly defined in claim 6 wherein said alarm circuit further includes a remote control element.

8. The swimming pool skimmer assembly defined in claim 6 wherein said alarm circuit alarm element includes an audible alarm.

9. The swimming pool skimmer assembly defined in claim 6 further including a deflector element mounted on said housing.

10. The swimming pool skimmer assembly defined in claim 5 further including a deflector element mounted on said housing.

11. The swimming pool skimmer assembly defined in claim 10 wherein said deflector element includes a flexible arm connected at one end thereof to said housing and having a circular deflection wheel mounted on another end thereof.

12. The swimming pool skimmer assembly defined in claim 11 wherein said housing has a longitudinal centerline and said circular deflection wheel has a center which lies on said housing longitudinal centerline.

* * * * *